US009797348B2

(12) United States Patent
Dudar

(10) Patent No.: US 9,797,348 B2
(45) Date of Patent: Oct. 24, 2017

(54) EVAPORATIVE EMISSIONS SYSTEM AND METHOD FOR A STOP/START VEHICLE

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 391 days.

(21) Appl. No.: 14/468,144

(22) Filed: Aug. 25, 2014

(65) Prior Publication Data

US 2016/0053726 A1 Feb. 25, 2016

(51) Int. Cl.
*F02M 33/04* (2006.01)
*F02M 25/08* (2006.01)

(52) U.S. Cl.
CPC ..... *F02M 25/089* (2013.01); *F02M 25/0809* (2013.01); *F02M 25/0836* (2013.01)

(58) Field of Classification Search
CPC ..... F02M 25/089; F02M 25/0809; F02M 25/0836
See application file for complete search history.

(56) References Cited

U.S. PATENT DOCUMENTS 5,396,873 A * 3/1995 Yamanaka ..... F02M 25/0809 123/520
5,450,834 A * 9/1995 Yamanaka ..... F02M 25/0818 123/198 D
5,542,397 A * 8/1996 Takahata ..... F02M 25/0809 123/520
5,678,523 A * 10/1997 Hashimoto ..... F02M 25/0809 123/520
5,775,307 A * 7/1998 Isobe ..... F02M 25/0809 123/198 D
5,845,625 A * 12/1998 Kidokoro ..... F02M 25/0836 123/520
5,911,209 A * 6/1999 Kouda ..... F02M 25/0809 123/198 D
5,996,400 A * 12/1999 Nishioka ..... F02M 25/0809 73/40.5 R
6,105,556 A * 8/2000 Takaku ..... F02M 25/0809 123/198 D
6,220,230 B1 * 4/2001 Kawamura ..... F02M 25/0809 123/520
6,308,559 B1 * 10/2001 Davison ..... F02M 25/0809 73/114.39

(Continued)

OTHER PUBLICATIONS

Werner, Matthew et al., "System and Method for Canister Purging with Low Manifold Vacuum," U.S. Appl. No. 14/069,191, filed Oct. 31, 2013, 30 pages.

(Continued)

*Primary Examiner* — David Hamaoui
(74) *Attorney, Agent, or Firm* — James Dottavio; McCoy Russell LLP

(57) ABSTRACT

Systems and methods for diagnosing individual components of an evaporative emissions system are presented. In one example, fuel vapor flow may be a basis for determining whether or not selected emission system components may be degraded. Further, fuel tank pressure may be another basis for determining component whether or not selected emissions system components may be degraded.

14 Claims, 6 Drawing Sheets

(56) References Cited

U.S. PATENT DOCUMENTS 6,321,727 B1 * 11/2001 Reddy ..... F02M 25/0809 123/520
6,382,191 B1 5/2002 Curran et al.
6,467,463 B2 * 10/2002 Kitamura ..... F02M 25/0809 123/516
6,561,166 B2 5/2003 Halleron et al.
6,564,781 B2 * 5/2003 Matsumoto ..... F02M 25/0809 123/519
6,736,117 B2 * 5/2004 Isobe ..... F02M 25/0809 123/520
6,950,742 B2 * 9/2005 Yamaguchi ..... G01M 3/025 123/520
6,988,396 B2 * 1/2006 Matsubara ..... F02M 25/089 73/114.38
7,043,972 B2 * 5/2006 Matsubara ..... F02M 25/0818 73/114.39
8,019,525 B2 9/2011 DeBastos et al.
8,056,540 B2 * 11/2011 DeBastos ..... F02M 25/0818 123/520
8,312,765 B2 * 11/2012 Pursifull ..... F02M 25/0836 73/114.39
8,447,495 B2 5/2013 Pearce et al.
8,560,167 B2 10/2013 Jentz et al.
9,353,708 B2 * 5/2016 Dudar ..... F02D 41/0032
2011/0079201 A1 4/2011 Peters et al.
2011/0265768 A1 11/2011 Kerns et al.
2011/0295482 A1 * 12/2011 Pearce ..... B60K 15/03504 701/102
2012/0152210 A1 * 6/2012 Reddy ..... F02M 25/089 123/520
2014/0026866 A1 1/2014 Pifher et al.
2014/0277927 A1 * 9/2014 Guo ..... F02M 25/0818 701/34.4
2015/0020780 A1 * 1/2015 Takakura ..... F02M 25/0809 123/520
2016/0290286 A1 * 10/2016 Dudar ..... F02M 25/0836

OTHER PUBLICATIONS

Vigild, Christian W. et al., "Methods and Systems for Fuel Canister Purge Flow Estimation with an Intake Oxygen Sensor," U.S. Appl. No. 14/155,261, filed Jan. 14, 2014, 51 pages.

* cited by examiner

EVAPORATIVE EMISSIONS SYSTEM AND METHOD FOR A STOP/START VEHICLE

FIELD

The present description relates to methods and systems for diagnosing operation of an evaporative emissions system. The methods may utilize present evaporative emissions sensors and actuators to evaluate individual evaporative emissions systems components for possible degradation.

BACKGROUND AND SUMMARY

An engine may include an evaporative emissions system for reducing an amount of fuel vapor that may escape from a vehicle. The evaporative emissions system may capture fuel vapors while the vehicle is parked and not operating, while the vehicle is being refueled, and while the vehicle is being operated. The vehicle may trap fuel vapors in a fuel vapor storage canister for subsequent introduction to the engine after the engine is started.

Regulatory agencies may require monitoring the evaporative emissions system to ensure its proper operation as the vehicle is used. One way to monitor the evaporative emissions system is to apply a vacuum to the evaporative emissions system and determine if the system leaks by more than a threshold amount over a specified period of time. However, leak checking the evaporative emissions system may not be as comprehensive as is desired to ensure proper evaporative emissions system operation. Therefore, it may be desirable to provide a more comprehensive method for establishing whether or not an evaporative emissions system is operating as is desired.

The inventor herein has recognized the above-mentioned predicament and has developed a method, comprising: responsive to selected conditions, commanding close a fuel vapor blocking valve while opening a canister vent valve and a canister purge valve; indicating a degradation of the canister vent valve or the canister purge valve responsive to a fuel vapor flow not decreasing while the canister purge valve is exposed to a threshold vacuum; and adjusting an actuator in response to indicating the degradation.

By commanding selected valves to predetermined operating states, it may be possible to provide the technical result of determining degradation of individual evaporative emissions system components in response to fuel vapor flow. For example, if a fuel vapor barrier valve is commanded closed along with commanding a canister purge valve open and a canister vent valve open, it may be determined that the canister purge valve is in a stuck closed position if fuel vapor flow does not decrease.

The present description may provide several advantages. In particular, the methods may identify degradation of individual emission systems components. Further, the methods may be implemented using existing sensors and actuators. Further still, mitigating actions may be taken if degradation is determined so that fewer evaporative emissions may be released to the atmosphere.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
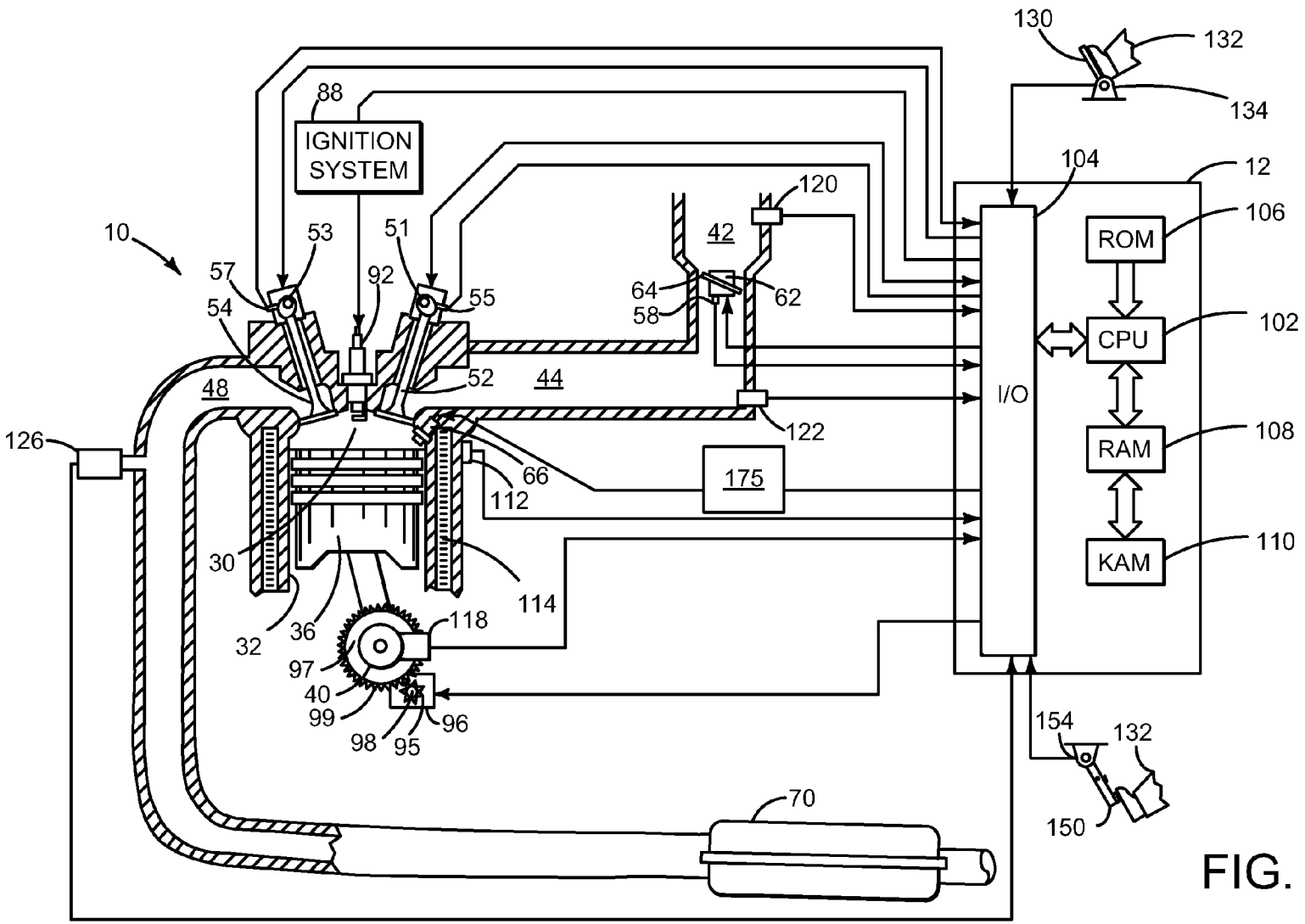
FIG. 1 is a schematic diagram of an engine.
Figure 2:
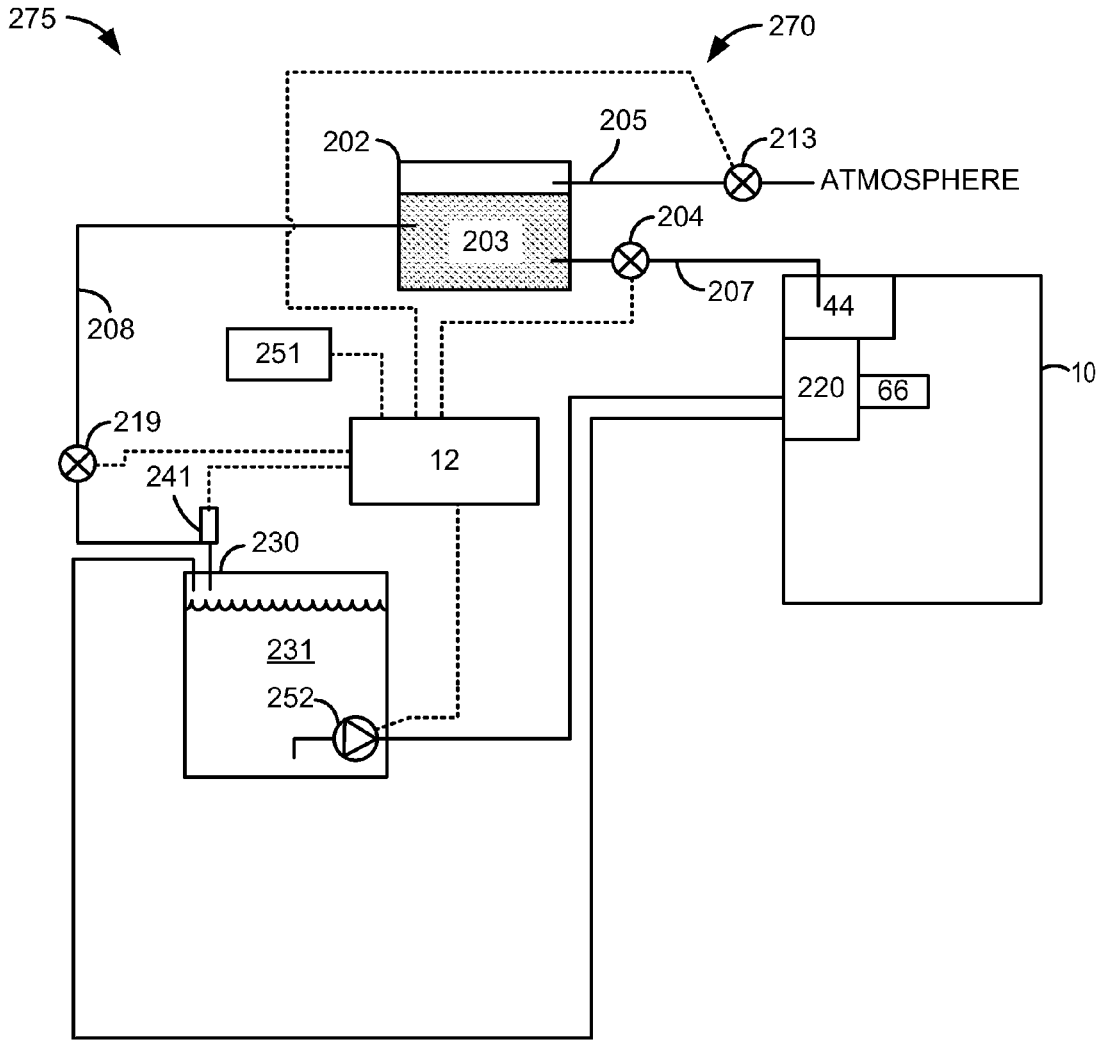
FIG. 2 is a schematic diagram of an example evaporative emissions system.
Figure 3:
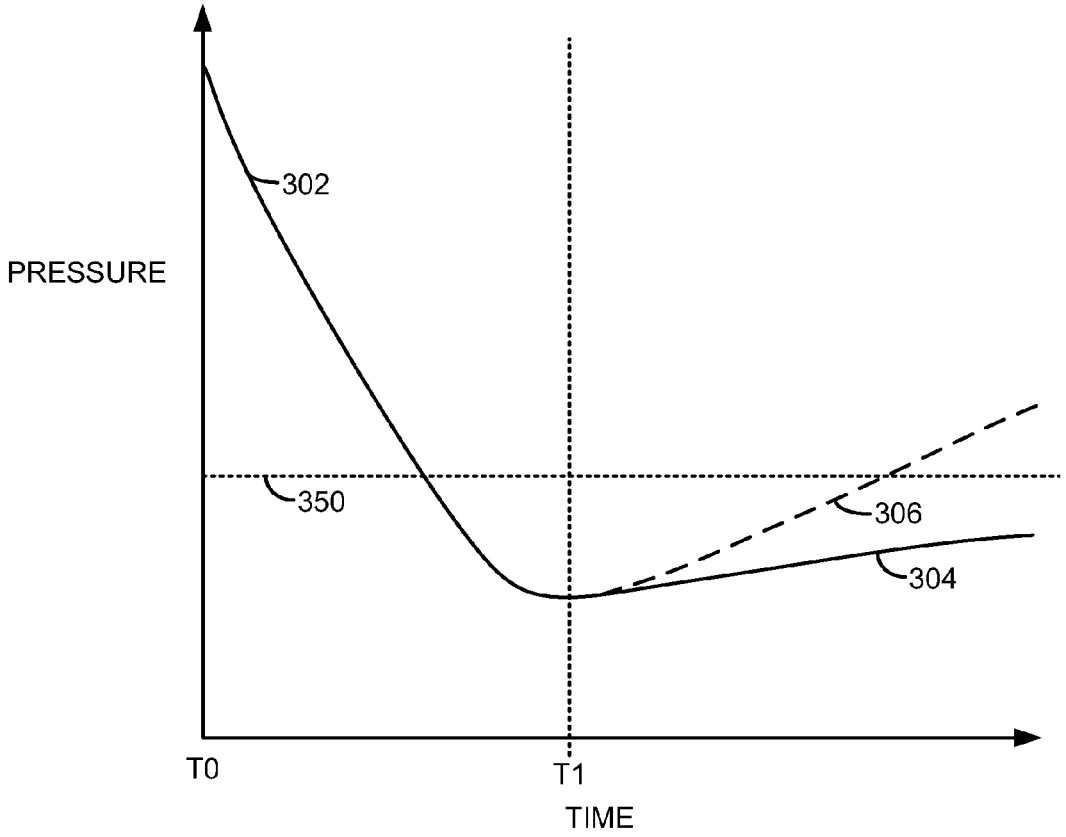
FIG. 3 is a plot of evaporative emissions system pressure during a portion of a leak diagnostic.
Figure 4A:
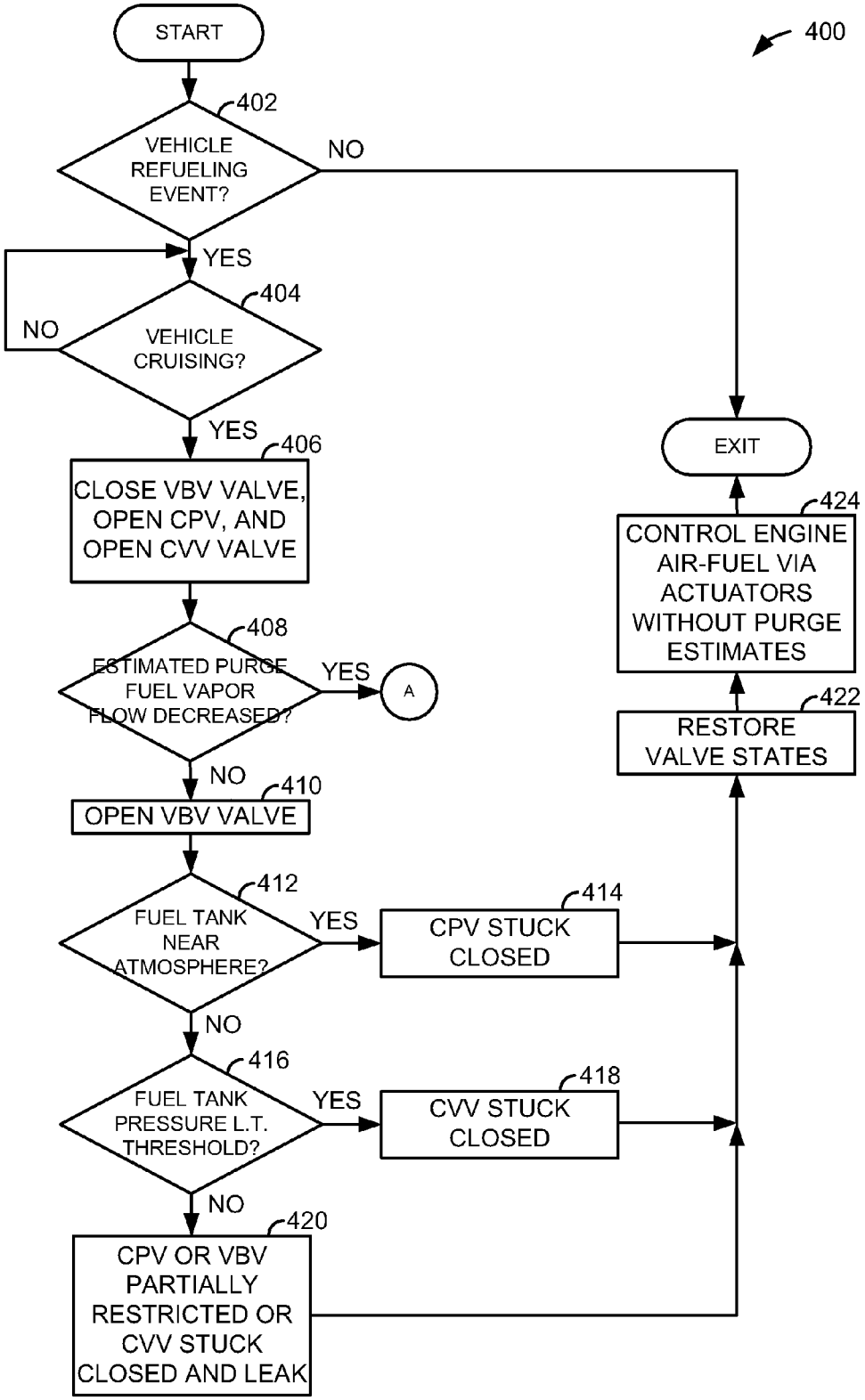
FIGS. 4A and 4B are a method for purging and diagnosing operation of a stop/start evaporative emissions system for a vehicle.
Figure 4B:
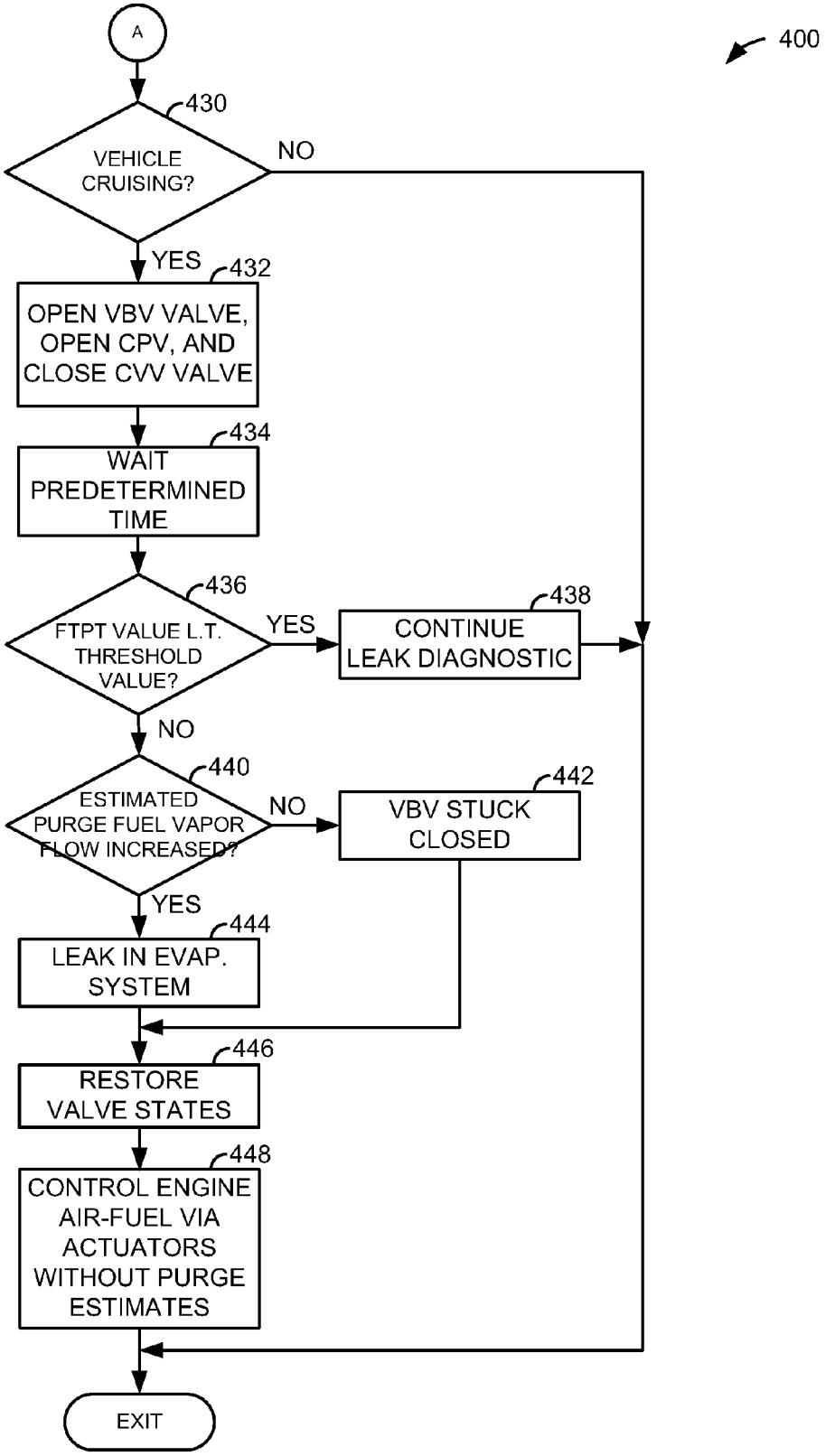
Figure 5:
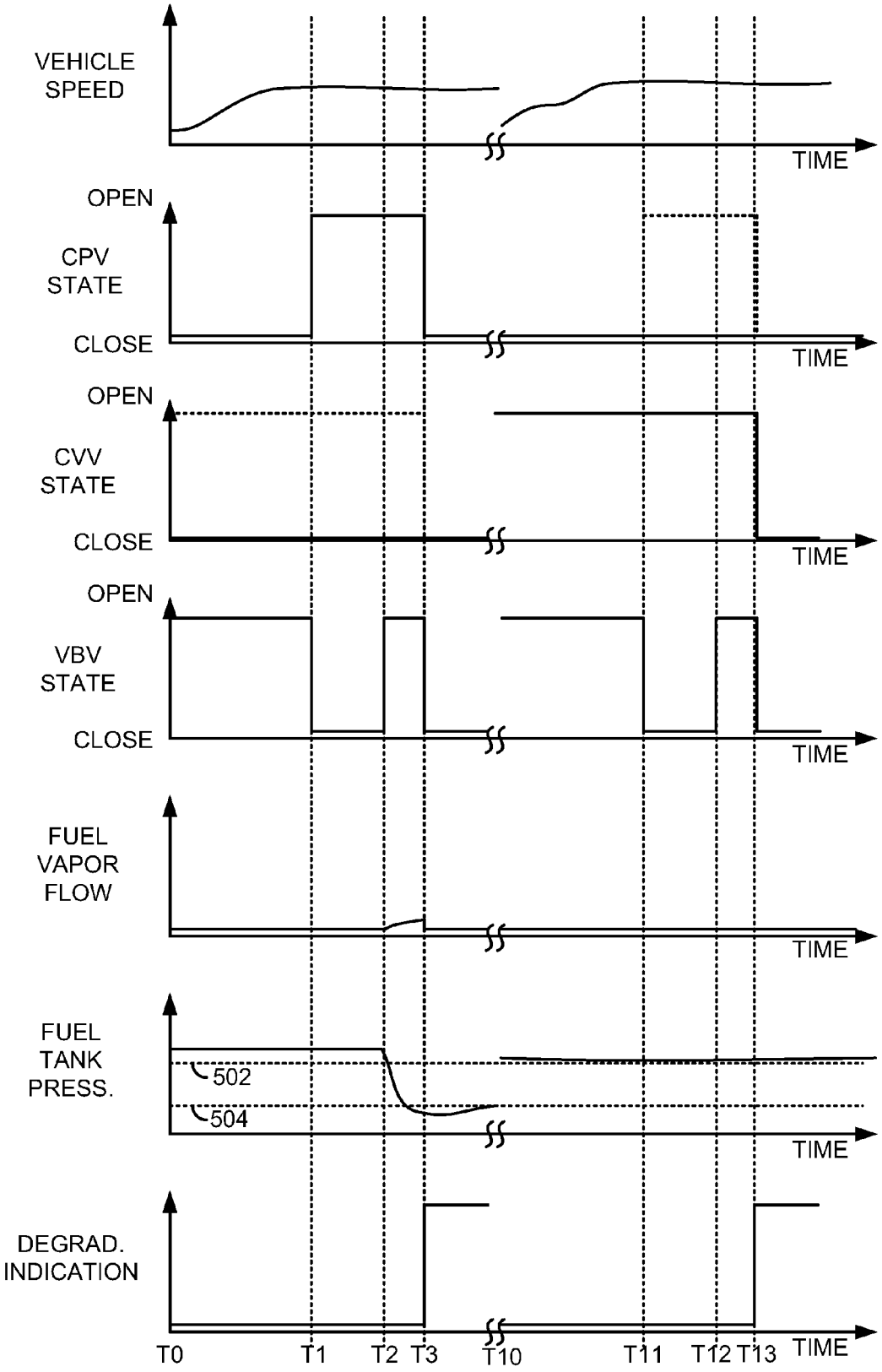
FIG. 5 is a plot of an example sequence for determining evaporative emission system component degradation.

The present description is related to diagnosing and controlling fuel vapor flow through an evaporative emissions system of a vehicle. The fuel vapors may be consumed by an engine as is shown in FIG. 1. The engine may be supplied fuel from a fuel system including an evaporative emissions system as is shown in FIG. 2. Leak diagnostics may be performed on the fuel system by exposing the fuel system to vacuum as is shown in FIG. 3. The method of FIGS. 4A and 4B provides for diagnosing degradation of the evaporative emissions system and adjusting actuators to mitigate vehicle emissions and performance in the presence of an indication of evaporative emission system degradation. Finally, FIG. 5 shows an example sequence for determining component degradation in an evaporative emissions system.

Referring to FIG. 1, internal combustion engine 10, comprising a plurality of cylinders, one cylinder of which is shown in FIG. 1, is controlled by electronic engine controller 12. Electrical connections between controller 12 and the various sensors and actuators are indicated by dashed lines.

Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake cam 51 and exhaust cam 53 may be moved relative to crankshaft 40.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal from controller 12. Fuel is delivered to fuel injector 66 by a fuel system 275 shown in greater detail in FIG. 2. In addition, intake manifold 44 is shown communicating with optional electronic throttle 62 which adjusts a position of throttle plate 64 to control air flow from air intake 42 to intake manifold 44. In one example, a high pressure, dual stage, fuel system may be used to generate higher fuel pressures. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by driver 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; brake pedal position from brake pedal position sensor 154 when driver 132 applies brake pedal 150; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2, an example fuel system 275 is shown in detail. The fuel system of FIG. 2 may supply fuel to engine 10 shown in detail in FIG. 1. Fuel system 275 includes evaporative emission system 270. The system of FIG. 2 may be operated according to the method of FIGS. 4A and 4B. Fuel system components and fluidic conduits are shown as solid lines and electrical connections are shown as dashed lines. The conduits represented by solid lines provide fluidic communication between devices linked by the conduits. Further, the conduits are coupled to the devices from which and to which they lead.

Evaporative emissions system 270 includes a fuel vapor storage canister 202 for storing fuel vapors. Evaporative emissions system 270 also includes carbon 203 for storing and releasing fuel vapors. Fuel vapor storage canister 202 is shown including atmospheric vent line 205 along which normally closed canister vent valve (CVV) 213 is placed to selectively allow air to flow into and out of fuel vapor storage canister 202. Fuel vapors may be supplied to fuel vapor storage canister 202 via conduit 208 and normally open fuel vapor blocking valve (VBV) 219. Fuel vapors may be purged via canister purge valve (CPV) 204 which allows fluidic communication between fuel vapor storage canister 202 and engine intake manifold 44 or intake 42 via conduit 207.

Engine 10 includes a fuel rail 220 that supplies fuel to direct fuel injector 66. Fuel vapors may be inducted into intake manifold 44 or intake 42 when intake manifold pressure is below atmospheric pressure. Fuel 231 is supplied from fuel tank 230 by fuel pump 252 to fuel rail 220. Pressure in fuel tank 232 may be measured via fuel tank pressure transducer (FTPT) 241 and relayed to controller 12. Controller 12 may receive inputs from the sensors described in FIG. 1 as well as sensor 241. Controller 12 also activates and deactivates CPV 204, CVV 213, VBV 219, and pump 252 in response to fuel system and engine operating conditions.

In one example, the system of FIG. 2 operates according to the method of FIGS. 4A and 4B via executable instructions stored in non-transitory memory of controller 12. While engine 10 is operating, fuel vapors from fuel tank 230 may be stored in fuel vapor storage canister 202 in response to temperatures in fuel tank 230 increasing.

Fuel vapors from fuel tank 230 may push air out of normally open CVV 213 when temperature and/or pressure in fuel tank 230 is increasing. If engine 10 is operating while vapors are being directed to fuel vapor storage canister 202, CPV 204 may be opened so that fuel vapors are drawn into and combusted in engine 10. If engine 10 is not operating or if CPV 204 is closed, fuel vapor may flow into fuel vapor storage canister 202 if temperature and/or pressure in fuel tank 230 increases such that fuel vapors flow to and are stored in fuel vapor storage canister 202.

On the other hand, if engine 10 is not operating or if CPV 204 is closed while temperature and/or pressure in fuel tank 230 is decreasing, fuel vapors from fuel vapor canister 202 may condense in fuel tanks 230 when VBV 219 is open. VBV 219 may be a normally open valve that is closed when CPV is open to improve vacuum formation in canister 202, thereby improving evacuation of fuel vapors from fuel vapor storage canister 202. Thus, the fuel system shown in FIG. 2 provides a way of decreasing a volume of the fuel vapor emissions system that is purged so that fuel vapor canister purging may be improved.

Controller 12 may indicate a condition of degradation of the CPV, VBV, and/or CVV on a display panel 251. Alternatively, 251 may be a light or other device to indicate degradation within the system.

Referring now to FIG. 3, a plot of simulated evaporative emissions system pressure during a portion of a leak diagnostic is shown. The plot has an X axis that represents time and a Y axis that represents pressure. Pressure increases in the direction of the Y axis arrow. Time increases in the direction of the X axis arrow. Horizontal line 350 represents a pressure threshold below which evaporative emissions system pressure may be desired to stay during a bleed up phase for there to be no determination of evaporative emission system degradation.

At time T0, a leak test begins and pressure is reduced in the evaporative emissions system fuel tank and evaporative emissions lines. The pressure may be reduced via opening the CPV 204 and closing CVV 213. The VBV is also in an open state so that fuel vapors may be drawn from the fuel tank 230. The engine intake manifold may be at a low pressure to evacuate fuel vapors from the fuel system. The evaporative emissions system is exposed to low intake manifold pressure from time T0 to time T1. Curve 302 shows evaporative emission system pressure being reduced. Time between T0 and T1 represents a vacuum pull down phase where fuel vapors are evacuated from the evaporative emissions system.

At time T1, the CPV 204 is closed and a timer starts incrementing to accumulate an amount of time pressure in the fuel system remains below threshold level 350. The timer accumulates time until a predetermined time expires or until evaporative emissions system pressure exceeds threshold 350. In this example, curve 306 represents a pressure level for an evaporative emissions system that is degraded since threshold 350 is exceeded. Curve 304 represents a pressure level for an evaporative emissions system that is not degraded since threshold 350 is not exceeded.

Referring now to FIGS. 4A and 4B, a method for purging and diagnosing operation of a stop/start vehicle is shown. The method of FIGS. 4A and 4B may be included in the system of FIGS. 1 and 2 as executable instructions stored in non-transitory memory.

At 402, method 400 judges if a vehicle refueling event has occurred. In one example, method 400 judges if a refueling event has occurred based on an output of a fuel tank level sensor. If method 400 judges that a refueling event has occurred, the answer is yes and method 400 proceeds to 404. Otherwise, the answer is no and method 400 proceeds to exit.

At 404, method 400 judges if the vehicle is in a cruising state. In one example, method 400 may judge the vehicle to be in a cruising state if the vehicle speed is substantially constant (e.g., ±8 KPH) and driver demand torque is substantially constant (e.g., changing by less than ±5%). If method 400 judges that the vehicle is cruising, the answer is yes and method 400 proceeds to 406. Otherwise, the answer is no and method 400 returns to 404.

At 406, method 400 closes the fuel vapor blocking valve (VBV) and opens the canister vent valve (CVV). Further, method 400 opens the canister purge valve (CPV). Closing the VBV prevents the fuel tank from being exposed to engine intake manifold vacuum and opening the CPV and CVV allows air to flow from atmosphere and through the fuel vapor storage canister where hydrocarbons may be liberated from the carbon. The fuel vapors may be drawn into the engine intake manifold as the lower intake manifold pressure induces flow. If the valves are operating as is desired, pressure in the fuel vapor storage canister remains near atmospheric pressure. Method 400 proceeds to 408 after the valve adjustments are made. Additionally, a delay period may be invoked between 406 and 408 to allow flow to stabilize.

At 408, method 400 judges if estimated purge fuel vapor flow to the engine from the fuel system is decreased when the CPV is exposed to a threshold (e.g., −4 inches of $H_2O$) or greater vacuum level (e.g., lower pressure). If estimated purge fuel vapor flow is decreased, it may be judged that the evaporative emissions system is operating as desired with the VBV closed, the CPV open, and the CVV open since the fuel vapor flow decreases as the canister is evacuated of fuel vapors. However, if the purge fuel vapor flow is not decreasing the CVV may be stuck closed or the CPV may be stuck closed because purge fuel vapor flow should decrease if the CVV and the CPV are open. If method 400 judges that purge fuel vapor flow is decreased, the answer is yes and method 400 proceeds to 430. Otherwise, the answer is no and method 400 proceeds to 410.

At 430, method 400 judges if the vehicle is in a cruising state. In one example, method 400 may judge the vehicle to be in a cruising state if the vehicle speed is substantially constant (e.g., ±8 KPH) and driver demand torque is substantially constant (e.g., changing by less than ±5%). If method 400 judges that the vehicle is cruising, the answer is yes and method 400 proceeds to 424. Otherwise, the answer is no and method 400 exits.

At 432, method 400 opens the fuel vapor blocking valve (VBV) and closes the canister vent solenoid (CVV). Further, method 400 opens the canister purge valve (CPV). Opening the VBV allows the fuel tank to be in fluidic communication with engine intake manifold vacuum, and closing the CVV prevents air from flowing from atmosphere through the fuel vapor storage canister. Fuel vapors may be drawn from the fuel tank and not from the fuel vapor storage canister into the engine intake manifold as the lower intake manifold pressure induces flow. If the valves are operating as is desired, pressure in the fuel tank may be reduced to approach engine intake manifold pressure. Method 400 proceeds to 434 after the valve adjustments are made.

At 434, method 400 waits and performs no valve control actions for a predetermined amount of time (e.g., ten seconds). Method 400 proceeds to 436 after the predetermined amount of time expires.

At 436, method 400 judges if the FTPT sensor output value is less than (L.T.) a threshold value. In one example, the threshold is 8 inches $H_2O$ of vacuum. If so, the answer is yes and method 400 proceeds to 438. Otherwise, the answer is no and method 400 proceeds to 440.

At 438, method 400 has determined that the VBV, CPV, and CPS valves are operating properly and continues with the leak test. In one example, the leak test continues by monitoring pressures in the fuel tank and fuel vapor storage canister. If the pressure rises by more than a predetermined pressure in a predetermined amount of time, it may be determined that there is a leak in the evaporative emissions system. If the pressure does not rise by more than the predetermined amount in the predetermined amount of time, it may be determined that there is no leak in the evaporative emissions system. FIG. 3 provides an example of leak testing. Method 400 proceeds to exit after continuing the leak diagnostic.

At 440, method 400 judges if an estimated purge fuel vapor flow to the engine from the fuel system has increased when the CPV is exposed to a threshold level of vacuum (e.g., −4 inches $H_2O$). If so, the answer is yes and method 400 proceeds to 444. Otherwise, the answer is no and method 400 proceeds to 442.

At 442, method 400 determines that the VBV valve is stuck closed and provides an indication that the VBV is stuck closed. The indication for a stuck VBV may be provided by activating a light or setting a bit in memory to a value of one. Method 400 outputs a diagnostic code for a stuck VBV and proceeds to 446 after providing an indication that the VBV is stuck closed.

At 444, method 400 determines that there is a leak in the evaporative emissions system. A leak in the evaporative emissions system may allow additional fuel vapors to be drawn into the engine intake manifold. Additionally, a leak in the evaporative emissions system may allow fuel vapors to escape to atmosphere when the engine is not operating. The indication of a leak may be provided by activating a light or setting a bit in memory to a value of one. Method 400 outputs a diagnostic code for a leak in the evaporative emissions system and proceeds to 446.

At 446, method 400 adjusts the operating states of the VBV, CPV, and CVV for normal operation (e.g., purging the canister and/or fuel tank). Alternatively, the VBV, CPV, and CVV may be closed. Method 400 proceeds to 448 after the operating states of the valves are restored.

At 448, method 400 controls engine actuator in response to the evaporative emissions system leak or stuck VBV. In one example, engine fuel injectors may be adjusted to compensate for additional air being drawn from the evaporative emissions system if the evaporative emissions system is leaking. For example, method 400 may increase the amount of fuel injector or decrease a throttle opening amount. If the VBV valve is stuck closed method 400 may operate the CPV and CVV valves to purge the canister for fuel vapors without attempting to operate the VBV valve. In other examples, the VBV valve may be commanded on and off several times to attempt to free the valve from the stuck position. Method 400 proceeds to exit after adjusting actuators.

At 410, method 400 opens the VBV. The VBV is opened to isolate what part of the system is not allowing the purge fuel vapor flow to be reduced. Method 400 proceeds to 410 after the VBV is commanded open.

At 412, method 400 judges if fuel tank pressure is near atmospheric pressure. For example, method 400 may judge the fuel tank to be near atmospheric pressure if fuel tank pressure is within 5 KPa of atmospheric pressure. If method 400 judges fuel tank pressure to be near atmospheric pressure, the answer is yes and method 400 proceeds to 414. Otherwise, the answer is no and method 400 proceeds to 416. If the fuel tank pressure is near atmospheric pressure it indicates that the passage between the fuel tank and the CVV is open and not being evacuated via engine vacuum.

At 414, method 400 indicates that the CPV is stuck closed. The fuel tank and fuel vapor storage canister may not be evacuated when the CPV is stuck closed. The indication for a stuck CPV may be provided by activating a light or setting a bit in memory to a value of one. Method 400 outputs a diagnostic code for a stuck CPV and proceeds to 422 after providing an indication that the CPV is stuck closed.

At 416, method 400 judges if fuel tank pressure is less than a threshold pressure. In one example, the threshold is 8 inches $H_2O$ of vacuum. If the fuel tank pressure is less than the threshold pressure (e.g., 10 inches $H_2O$ of vacuum), the answer is yes and method 400 proceeds to 418. Otherwise, the answer is no and method 400 proceeds to 420.

At 418, method 400 indicates that the CVV is stuck closed. The fuel tank and fuel vapor storage canister may be evacuated to a low pressure when the CVV is stuck closed. The indication for a stuck CVV may be provided by activating a light or setting a bit in memory to a value of one. Method 400 outputs a diagnostic code for a stuck CVV and proceeds to 422 after providing an indication that the CVV is stuck closed.

At 420, method 400 indicates that the CPV or VBV is partially restricted, or that the CVV is stuck closed and the evaporative emission system is leaking. A partially functioning CPV or VBV may allow fuel tank pressure to be lower than atmosphere, but not low enough to be below the threshold pressure. Alternatively, a stuck closed CVV and a system pressure leak may also allow fuel tank pressure to be lower than atmosphere, but not low enough to be below the threshold pressure. Method 400 proceeds to 422 after indicating CPV, VBV, and CVV conditions.

At 422, method 400 adjusts the operating states of the VBV, CPV, and CVV for normal operation (e.g., purging the canister and/or fuel tank). Alternatively, the VBV, CPV, and CVV may be closed. Method 400 proceeds to 424 after the operating states of the valves are restored.

At 424, method 400 controls engine actuator in response to the evaporative emissions system leak and stuck CVV, or a stuck CPV, or a stuck CVV. In one example, engine fuel injectors may be adjusted to compensate for the absence of fuel vapors and air being drawn through the CPV. For example, method 400 may decrease the amount of fuel injector and/or increase a throttle opening amount. If the CVV valve is stuck closed method 400 may operate the CPV and VBV valves to purge the canister and fuel tank of fuel vapors without attempting to operate the CVV valve. If the CPV is determined to be degraded the CVV may be commanded closed; however, if fuel tank pressure increases to a threshold pressure, the CVV may be commanded open. In other examples, the CVV and/or the CPV may be commanded on and off several times to attempt to free the valves from their stuck positions. Method 400 proceeds to exit after adjusting actuators.

Thus, the method of FIGS. 4A and 4B provides for a method, comprising: responsive to selected conditions, commanding close a fuel vapor blocking valve while opening a canister vent valve and a canister purge valve; indicating a degradation of the canister vent valve or the canister purge valve responsive to a fuel vapor flow not decreasing while the canister purge valve is exposed to a threshold vacuum; and adjusting an actuator in response to indicating the degradation. The method includes where the actuator is the canister vent valve when the canister purge valve is determined degraded, and where the canister vent valve is held closed. The method further comprises opening the canister vent valve in response to a pressure in a fuel tank exceeding a threshold pressure. The method includes where the actuator is a light or a display panel.

In some examples, the method includes where indicating the canister vent valve is degraded is in further response to a fuel tank pressure less than a threshold pressure, and further comprising commanding opening of a vapor blocking valve prior to determining the canister vent valve is degraded. The method includes where the canister purge valve is indicated degraded in further response to a fuel tank pressure being within a predetermined pressure of atmospheric pressure, and further comprising commanding opening of a vapor blocking valve prior to determining the canister vent valve is degraded. The method also includes where the selected conditions include the vehicle cruising.

In another example, the method of FIGS. 4A and 4B provides for method, comprising: responsive to selected conditions, commanding close a fuel vapor blocking valve while opening a canister vent valve and a canister purge valve; indicating a degradation of the canister vent valve or the canister purge valve responsive to a fuel vapor flow not decreasing while the canister purge valve is exposed to a threshold vacuum; otherwise, commanding close the canister vent valve, opening the canister vent valve, and opening the fuel vapor blocking valve; indicating a degradation of the fuel vapor blocking valve responsive to the fuel vapor flow not increasing while the canister purge valve is exposed to a threshold vacuum; and adjusting an actuator in response to degradation of the canister vent valve, the canister purge valve, or the fuel vapor blocking valve.

In one example, the method includes where the canister vent valve is positioned along a conduit providing fluidic communication between a fuel vapor storage canister and atmosphere, where the canister purge valve is positioned along a conduit providing fluidic communication between an engine and the fuel vapor storage canister, and where the fuel vapor blocking valve is positioned along a conduit between a fuel tank and the fuel vapor storage canister. The method also includes where the actuator is the canister vent valve when the canister purge valve is determined degraded, and where the canister vent valve is held closed.

Additionally, the method further comprises opening the canister vent valve in response to a pressure in a fuel tank exceeding a threshold pressure. The method includes where the actuator is a light or a display panel. The method includes where the selected conditions include a vehicle refueling event. The method further comprises indicating a partially restricted canister purge valve or a partially restricted fuel vapor blocking valve in further response to fuel tank pressure not less than a threshold pressure when commanding the fuel vapor blocking valve closed, the canister purge valve open, and the canister vent valve open.

In still another example, the method of FIGS. 4A and 4B provides for a method, comprising: responsive to selected conditions, commanding close a fuel vapor blocking valve while opening a canister vent valve and a canister purge valve; indicating a degradation of the canister vent valve or the canister purge valve responsive to a fuel vapor flow estimate not decreasing while the canister vent valve is exposed to a threshold vacuum; otherwise, commanding open the fuel vapor blocking valve, opening the canister purge valve, and closing the canister vent valve; indicating excess flow in an evaporative emissions system responsive to the fuel vapor flow estimate increasing; and adjusting an actuator in response to degradation of the canister vent valve, the canister purge valve, or the indication of excess flow.

Additionally, the method includes where the actuator is a light or a display panel. The method further comprises indicating fuel vapor blocking valve degradation responsive to the fuel vapor flow estimate not increasing while the fuel vapor blocking valve is commanded open, the canister purge valve is commanded open, and the canister vent valve is commanded closed. The method also includes where the selected conditions include a vehicle refueling event. The method further comprises indicating the excess flow in the evaporative emissions system responsive to fuel tank pressure not being less than a threshold value. The method further comprises performing a leak diagnostic in response to the fuel tank pressure being less than the threshold value.

Referring now the FIG. 5, an example sequence for determining emission system component degradation is shown. The sequence of FIG. 5 may be provided by the method of FIG. 5 in the system of FIGS. 1 and 2. The double S in the center of each plot represents a discontinuity of time that may be long or short in duration. The conditions on one side of the double S may be different from the conditions on the other side of the double S. Vertical lines at times T1-T3 and T12-T14 represent time of interest in the sequence.

The first plot from the top of FIG. 5 is a plot of vehicle speed versus time. The X axis represents time and time increases from the right to left side of the plot. The Y axis represents vehicle speed and vehicle speed increases in the direction of the Y axis arrow.

The second plot from the top of FIG. 5 is a plot of canister purge valve (CPV) state versus time. The X axis represents time and time increases from the right to left side of the plot. The Y axis represents CPV state and the CPV is open when the solid line trace is near the Y axis arrow and closed when the solid line trace is near the X axis. The dotted line trace represents the command to the CPV and the solid line represents the actual CPV state. The CPV command and actual state are the same when only the solid trace is visible.

The third plot from the top of FIG. 5 is a plot of canister vent valve (CVV) state versus time. The X axis represents time and time increases from the right to left side of the plot. The Y axis represents CVV state and the CVV is open when the solid line trace is near the Y axis arrow and closed when the solid line trace is near the X axis. The dotted line trace represents the command to the CVV and the solid line represents the actual CVV state. The CVV command and actual state are the same when only the solid trace is visible.

The fourth plot from the top of FIG. 5 is a plot of fuel vapor blocking valve (VBV) state versus time. The X axis represents time and time increases from the right to left side of the plot. The Y axis represents VBV state and the VBV is open when the solid line trace is near the Y axis arrow and closed when the solid line trace is near the X axis.

The fifth plot from the top of FIG. 5 is a plot of fuel vapor flow versus time. The X axis represents time and time increases from the right to left side of the plot. The Y axis represents fuel vapor flow and fuel vapor flow increases in the direction of the Y axis arrow.

The sixth plot from the top of FIG. 5 is a plot of fuel tank pressure versus time. The X axis represents time and time increases from the right to left side of the plot. The Y axis represents fuel tank pressure and fuel tank pressure increases in the direction of the Y axis arrow. Horizontal line 502 represents atmospheric pressure and horizontal line 504 represents a threshold pressure (e.g., 8 in $H_2O$) for determining evaporative emission component degradation. Pressures above atmospheric pressure are positive and pressures below atmospheric are vacuums.

The seventh plot from the top of FIG. 5 is a plot of a variable or diagnostic code that indicates a presence or absence of evaporative emissions system degradation versus time. The X axis represents time and time increases from the right to left side of the plot. The Y axis represents vehicle speed and vehicle speed increases in the direction of the Y axis arrow.

At time T0, vehicle speed is increasing. The CPV is closed, the CVV is closed, and the VBV is open. However, the CVV is commanded open. Fuel vapor flow is near zero and fuel tank pressure is greater than atmospheric pressure. Fuel tank pressure may increase due to an increase in fuel temperature. There is no indication of degradation.

At time T1, vehicle speed is stabilized and the vehicle is cruising causing a diagnostic to be executed. The diagnostic commands the CPV open, the CVV open, and the VBV closed. However, in this example, the CVV remains in a stuck closed position. The fuel vapor flow does not increase and the fuel tank pressure remains unchanged since the VBV is closed. Degradation is not indicated.

At time T2, the VBV is commanded open and the CPV and CVV remain commanded open. The fuel tank pressure is reduced as engine vacuum is applied to the fuel tank via the open VBV and CPV. The fuel vapor flow to the engine increases as fuel vapors are drawn from the fuel tank. The indication of degradation is not asserted.

Between time T2 and time T3, the fuel tank pressure is reduced to a level below threshold pressure 504. The low fuel tank pressure provides an indication of CVV degradation since if the CVV were open, pressure in the fuel tank would not be drawn so low because air would be drawn from atmosphere.

At time T3, the degradation indication variable changes state from a low level to a high level to indicate CVV degradation. Further, the CPV, CVV, and VBV are commanded closed in response to the indication of CVV degradation.

At time T10, vehicle speed is increasing. The CPV is closed, the CVV is open, and the VBV is open. Fuel vapor flow to the engine is near zero since the CPV is closed. Fuel tank pressure is near atmospheric pressure since the CVV and VBV are open and fuel vapors are allowed to migrate from the fuel tank to the fuel vapor storage canister. There is no indication of degradation.

At time T11, vehicle speed is stabilized and the vehicle is cruising causing a diagnostic to be executed. The diagnostic commands the CPV open, the CVV open, and the VBV closed. However, in this example, the CPV remains in a stuck closed position. The fuel vapor flow to the engine does not increase and the fuel tank pressure remains unchanged since the VBV is closed. Degradation is not indicated.

At time T12, the VBV is commanded open and the CPV and CVV remain commanded open. The fuel tank pressure is not reduced since the CPV is stuck and engine vacuum is not applied to the fuel tank. The fuel vapor flow to the engine does not increase and there is no indication of degradation.

At time T13, the degradation indication variable changes state from a low level to a high level to indicate CPV degradation. Further, the CPV, CVV, and VBV are commanded closed in response to the indication of CVV degradation. The CPV is indicated degraded because the purge fuel vapor flow to the engine does not increase and because the fuel tank pressure is not reduced to less than a threshold pressure.

Thus, CPV and CVV degradation may be determined from fuel vapor flow to the engine and fuel tank pressure by way of existing sensors and selectively operating predetermined actuators. Similar degradation determining sequences may be provide for determining VBV degradation and leaks or undesired breakdown between an interior volume of the evaporative emissions system and atmosphere.

As will be appreciated by one of ordinary skill in the art, method described in FIGS. 4A and 4B may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used. Further, the described actions, operations, methods, and/or functions may graphically represent code to be programmed into non-transitory memory of the computer readable storage medium in the engine control system.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method, comprising:

responsive to selected conditions, commanding closed a fuel vapor blocking valve while commanding open a canister vent valve and a canister purge valve as a first condition of valve commands:

then, responsive to an amount of purge fuel vapor supplied to the engine not decreasing while the canister purge valve is exposed to a threshold vacuum under the selected conditions and the first condition of valve commands, commanding open the fuel vapor blocking valve while retaining the open commands to the canister vent valve and canister purge valve as a second condition of valve commands;

indicating a degradation of the canister vent valve or the canister purge valve responsive to a fuel tank pressure in the second condition of valve commands; and adjusting an actuator in response to indicating the degradation.

2. The method of claim 1, further comprising holding the canister vent valve closed in response to indicating the canister purge valve is degraded.

3. The method of claim 2, wherein adjusting the actuator further comprises adjusting an engine fuel injector to compensate for an absence of fuel vapors and air being drawn through the canister purge valve in response to indicating the canister purge valve is degraded, and further comprising opening the canister vent valve in response to pressure in a fuel tank exceeding a threshold pressure.

4. The method of claim 1, where the actuator is a light or a display panel.

5. The method of claim 1, where indicating the canister vent valve is degraded is in response to the fuel tank pressure being less than a threshold pressure.

6. The method of claim 1, where the canister purge valve is indicated degraded in response to the fuel tank pressure being within a predetermined pressure of atmospheric pressure.

7. The method of claim 1, where the selected conditions include vehicle cruising.

8. The method of claim 1, wherein responsive to an amount of purge fuel vapor supplied to the engine decreasing while the canister purge valve is exposed to a threshold vacuum under the selected conditions and the first condition of valve commands, commanding closed the canister vent valve and commanding open the canister purge valve and the fuel vapor blocking valve as a third condition of valve commands, indicating a degradation of the fuel vapor blocking valve responsive to an amount of purge fuel vapor supplied to the engine not increasing while the canister purge valve is exposed to the threshold vacuum in the third condition of valve commands; and adjusting an actuator in response to indicating the degradation of the fuel vapor blocking valve.

9. The method of claim 8, where the canister vent valve is positioned along a conduit providing fluidic communication between a fuel vapor storage canister and atmosphere, where the canister purge valve is positioned along a conduit providing fluidic communication between an engine and the fuel vapor storage canister, and where the fuel vapor blocking valve is positioned along a conduit between a fuel tank and the fuel vapor storage canister, and wherein indicating the degradation of the fuel vapor blocking valve responsive to an amount of purge fuel vapor supplied to the engine not increasing while the canister purge valve is exposed to the threshold vacuum in the third condition of valve commands comprises indicating the degradation of the fuel vapor blocking valve responsive to a fuel vapor flow from the fuel tank to the engine not increasing while the canister purge valve is exposed to the threshold vacuum in the third condition of valve commands.

10. The method of claim 9 further comprising holding the canister vent valve closed in response to degradation of the canister purge valve.

11. The method of claim 10, further comprising commanding open the canister vent valve in response to a pressure in the fuel tank exceeding a threshold pressure.

12. The method of claim 8, where the actuator is a light or a display panel, and further comprising, when the canister vent valve is commanded closed, the canister purge valve is commanded open, and the fuel vapor blocking valve is commanded open, and responsive to a pressure in the fuel tank being less than a threshold pressure, commanding closed the canister purge valve and indicating a leak in the evaporative emissions system responsive to an evaporative emissions system pressure greater than a threshold.

13. The method of claim 8, where the selected conditions include a vehicle cruising event following a vehicle refueling event.

14. The method of claim 8, further comprising indicating a partially restricted canister purge valve or a partially restricted fuel vapor blocking valve in further response to fuel tank pressure being not less than a threshold pressure when commanding the fuel vapor blocking valve closed, the canister purge valve open, and the canister vent valve open.

* * * * *